United States Patent [19]

Kealoha

[11] 4,238,864

[45] Dec. 16, 1980

[54] DIVER'S FLOATER

[76] Inventor: Gregory Kealoha, 1234 13th Ave., Honolulu, Hi. 96816

[21] Appl. No.: 917,362

[22] Filed: Jun. 20, 1978

[51] Int. Cl.[2] ..... B63B 21/52

[52] U.S. Cl. ..... 9/8 R; 9/9; 242/125.3

[58] Field of Search ..... 9/8 R, 8.3 R, 8.3 E, 9/9; 43/43.11; 405/185, 186; 273/58 R, 63 R; 242/84.1 L, 84.2 B, 125.2, 125.3

[56] References Cited

U.S. PATENT DOCUMENTS

| | | | |
|---|---|---|---|
| 1,316,683 | 9/1919 | Calvert | 273/63 E X |
| 2,515,715 | 7/1950 | Jones | 273/63 R X |
| 2,806,659 | 9/1957 | Marcoff-Moghadam | 242/125.3 |
| 2,938,655 | 5/1960 | Wachter | 242/125.2 X |
| 3,037,217 | 6/1962 | Mandra | 9/8 R |
| 3,048,814 | 8/1962 | Francois | 9/8 R X |
| 3,309,649 | 3/1967 | Ballard et al. | 9/8 R X |
| 3,340,644 | 9/1967 | Lintz | 43/43.11 |
| 3,364,613 | 1/1968 | Sewell | 43/43.11 |
| 3,441,962 | 5/1969 | Williams | 9/9 |
| 3,553,751 | 1/1971 | Lewis | 9/9 |
| 3,755,953 | 9/1973 | Mliner | 43/43.11 |
| 3,822,499 | 7/1974 | De Vos | 9/8 R X |
| 3,827,093 | 8/1974 | Davis | 9/8 R |
| 4,103,379 | 8/1978 | Wolfe | 43/43.11 X |

*Primary Examiner*—Trygve M. Blix
*Assistant Examiner*—Winston H. Douglas
*Attorney, Agent, or Firm*—Cushman, Darby & Cushman

[57] ABSTRACT

A diver's floater is disclosed having a spherical float body with a circumferential groove thereabout in which a line may be stored, which line connects the float body to the diver. A clip, attached to the float body, under which preselected turns of the line may be secured, serves the dual purpose of preventing excessive line from unwrapping and providing distance indications to the diver. In one embodiment of the invention, wherein the float body is hollow, access to the float body interior is provided so that equipment may be stored therein. A support is also provided for storing equipment and the like external to the float body.

13 Claims, 4 Drawing Figures

DIVER'S FLOATER

The present invention relates to a diver's floater and more specifically to a buoyant diver's floater which may be attached to a submerged diver by means of a line to mark the position of the diver, store equipment and otherwise serve as a life support device.

A number of marking floats or buoys are known in the art. U.S. Pat. No. 3,441,962 to Williams discloses a spherical float marker designed to store and selectively release a line from a circumferential groove. Friction means are provided which continuously resist the release of the line in order to prevent excessive unwrapping.

U.S. Pat. No. 3,827,093 to Davis also discloses a spherical float having a circumferential groove in which line is stored. The wound line is covered and held within the groove by means of an encircling resilient band which exerts continuous friction on the line to act as an unwinding break.

U.S. Pat. No. 3,037,217 to Mandra discloses a spherical float having a line wound around a cylindrical spool which projects from the float. A clip on the spool restrains the unwinding of the line from the spool. As force is applied to the line causing it to tend to unwind, the resistance of the clip must be overcome in order to release more line once every revolution of the line with respect to the spool.

Thus, the above-cited patents all teach the application of continuous, or nearly continuous, friction on a line in order to prevent excessive unwrapping. This is a distinct disadvantage in a diver's floater, since the diver must continuously exert a force overcoming the frictional force of the device to dive more deeply. Furthermore, none of these references provides means for the storage of equipment during a dive.

The present invention overcomes these disadvantages. The diver's floater of the present invention includes a float body about which line may be wound. Retaining means are also provided for maintaining preselected points of the line proximate the float body until a predetermined force is applied to the line to prevent more than preselected lengths of the line from unwrapping from the float body unless the predetermined force is applied. In one embodiment, the float body has a hole through which the interior of the body may be accessed for the storage of equipment therein. The hole may be covered with handle means having threads capable of engaging threads about the float body hole, which handle means forms a watertight seal with the float body.

The retaining means of the present invention may be a resilient clip associated with a circumferential groove about the float body, under which clip preselected turns of the line may be secured. In this fashion, the clip serves the dual function of preventing excessive line from unwrapping from the groove, and providing distance indications to the diver, since the points at which the diver feels resistance on the line are indications of depth, or at least distance from the float.

These and other objects and advantages of the invention will become more apparent and more readily appreciated from the following detailed description of the presently preferred exemplary embodiments of the invention taken in conjunction with the accompanying drawings, of which:

Figure 1:
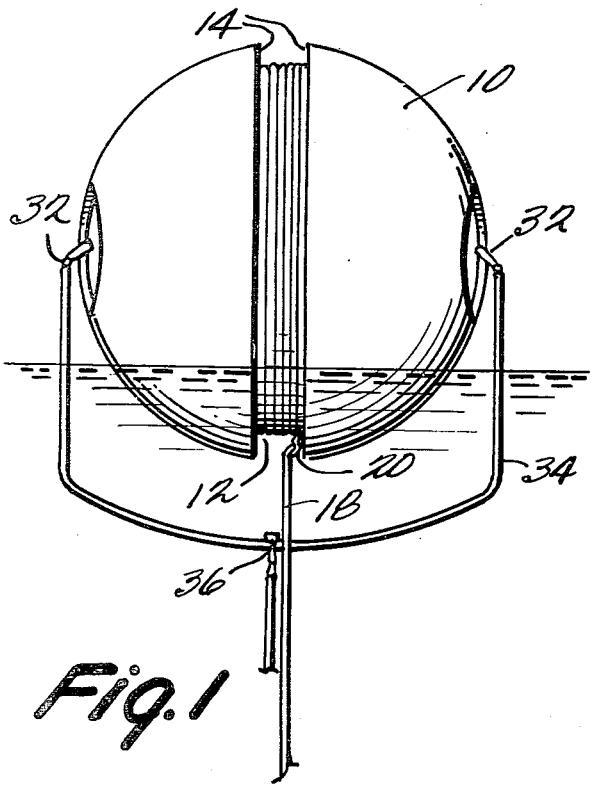
FIG. 1 is a side elevational view of the present invention.

Referring first to FIG. 1, float body 10 is generally spherical in shape with a circumferential groove 12 defined by walls 14. Float body 10 may be constructed of any material having an average specific gravity less than that of water, such as styrene. Alternatively, float body 10 is constructed of a plastic material forming a waterproof hollow shell, and is preferably molded in one piece.

Flexible means such as line 18 is attached to a surface of groove 12 and may be wound within the groove. Line 18 may be marked at predetermined lengths with tape, paint or the like to provide a quick indication of length from the end of line 18.

Retaining means, such as pressure clip 20 is attached to one of walls 14. Selected turns of line 18 wound around groove 12 may be secured under pressure clip 20 so that line 18 will not unwrap unless a predetermined force is applied to line 18, sufficient to overcome the frictional resistance applied by pressure clip 20.

In operation, prior to a dive, the diver may clip preselected points of line 18 under pressure clip 20. Preferably, the diver knows the length of line between clipped points. The diver then attaches the end of line 18 to his body and dives.

The diver will be substantially unhindered by resistance from the line until the line is unwrapped is the first point secured by pressure clip 20. The increased resistance will indicate to the diver that he is at the first preselected distance from float body 10. A tug on line 18 will free the point from clip 20. Thus, line 18 may continue to unwind from groove 12 without resistance from pressure clip 20 until the next point secured by clip 20 is reached. When the line has unwound to the next point, and the diver feels resistance from the line, the diver again has an indication of depth.

Figure 3:
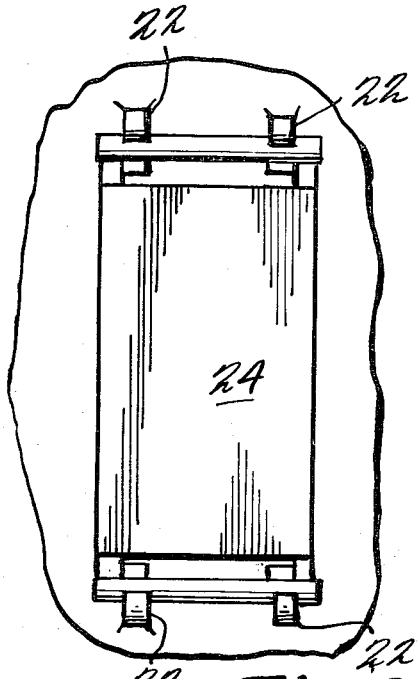
FIG. 3 is a sectional view taken along the III—III line of FIG. 2.
Figure 2:
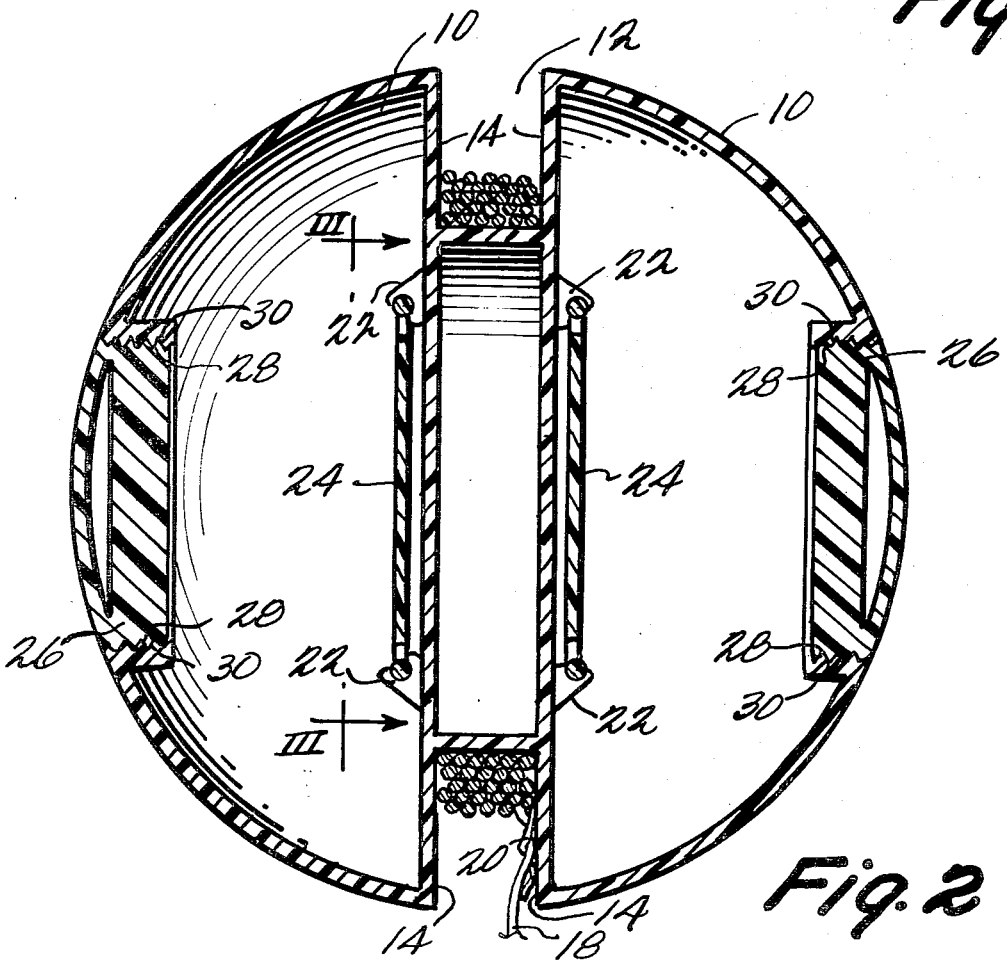
FIG. 2 is a side elevational section of the present invention.
Figure 4:
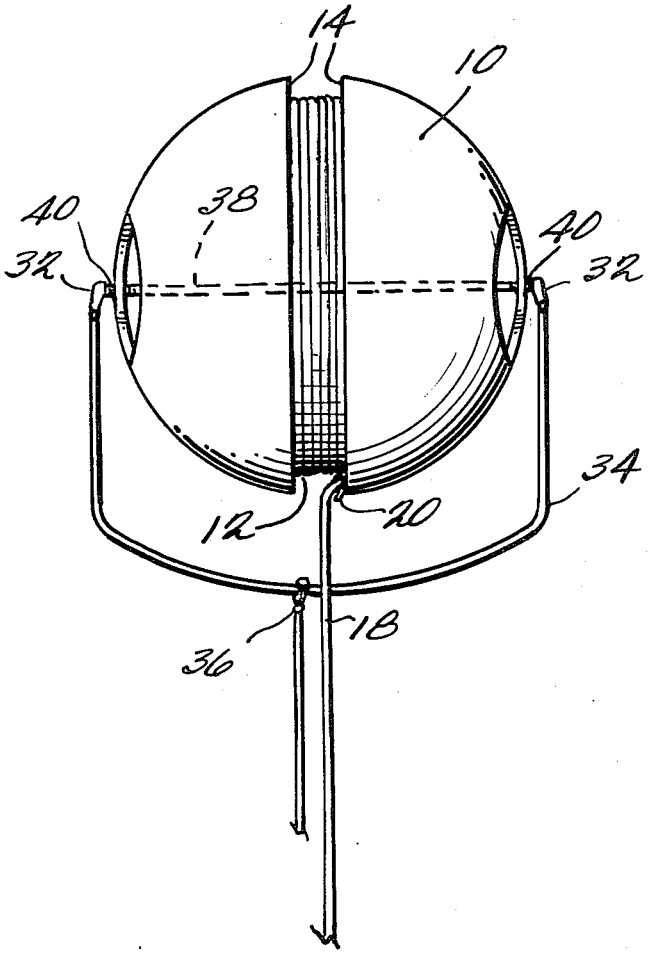
FIG. 4 is a side elevational view of a second embodiment of the present invention.

In one embodiment of the present invention, float body 10 is hollow and made of plastic. As illustrated in FIGS. 2 and 3, means are included for storing equipment within float body 10. Inner walls 14 separate float body 10 into hemispheres. Mounted on walls 14 are clips 22 positioned appropriately to receive equipment rack 24. The interior of float body 10 is accessed by means of handles 26 having threads 28 which are designed to engage threads 30 on float body 10. When handles 26 are screwed in place, a watertight seal is formed between handles 26 and float body 10.

Handles 26 are preferably arranged so that when they are screwed in place the outer contours thereof conform to the general spherical shape of float body 10. As illustrated in FIGS. 1 and 2, the outer contours of handles 26 complete the spherical outer contour of float body 10. This feature reduces considerably the friction between float body 10 and the water, thereby easing the exertions of the diver.

In operation, equipment, such as flares, a raft, a first aid kit, batteries and light, or any other equipment is fastened to equipment rack 24. The battery operated light is particularly useful as a position marker during night diving. Handles 26 are unscrewed from float body 10, and racks 24 are inserted through the holes in float body 10 defined by threads 30 and engaged with clips 22.

In another embodiment, float body 10 is comprised of two solid hemispheres made of styrene. A corrosion resistant rod, such as stainless steel, passes through the approximate center of the float body and has threaded ends for removable attachment with threaded handles. The rod holds together the various sections of the float body. If clips and swivels are utilized to store equipment external to float body 10, they may be attached directly to the threaded portions of the steel rod.

As illustrated in FIG. 1, clips and swivels 32 may be attached to handles 26 if desired. From clips and swivels 32 may be suspended equipment support 34 having a third clip and swivel 36. Any sort of equipment which may be suitably stored external to float body 10 may be suspended from clip and swivel 36. For example, a bag may be attached to clip and swivel 36 for holding shells, coral, and the like, or various implements. Alternatively, a fish stringer may be attached to clip and swivel 36.

Thus, the present invention serves a number of functions such as marking the position of a diver, providing an indication of depth for the diver, storing equipment, and providing an extra margin of safety during swimming, snorkeling, skin diving and scuba diving. The device provides this safety factor by generally orienting the diver, and, in addition, by providing a floating device which may be clung to in times of distress.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A diver's floater comprising:

a float body having an average specific gravity less than that of water;

flexible means, having one end attached to said float body, for connecting said float body to said diver, said flexible means being wound around said float body during storage; and retaining means, attached to said float body and operatively associated with said flexible means, for maintaining preselected points of said flexible means proximate said float body until a predetermined force is applied to said flexible means, said preselected points being separated by a distance greater than the circumference of said float body, and said retaining means for preventing more than preselected lengths of said flexible means from unwinding from said float body until said predetermined force is applied to said flexible means, said lengths being greater than the circumference of said float body.

2. Apparatus as in claim 1 wherein:

said float body is solid; and said diver's floater further comprises a corrosion resistant rod passing through the approximate center of each section, and handle means, removably attached to said rod, for providing a handle for said diver.

3. Apparatus as in either claim 1 or 2 wherein said float body is styrene.

4. A diver'floater comprising:

a float body having a hollow interior and an average specific gravity less than that of water;

flexible means, having one end attached to said float body, for connecting said float body to said diver, said flexible means being wound around said float body during storage;

retaining means, attached to said float body and operatively associated with said flexible means, for maintaining preselected points of said flexible means proximate said float body until a predetermined force is applied to said flexible means, said preselected points being separated by a distance greater than the circumference of said float body, and said retaining means for preventing more than preselected lengths of said flexible means from unwinding from said float body until said predetermined force is applied to said flexible means, said lengths being greater than the circumference of said float body means for accessing the interior of said float body, said accessing means including means defining holes in said float body, said hole defining means having threads, and handle means having threads whereby said handle means threads may removably engage said hole defining means threads forming a watertight seal therebetween; and means for storing equipment in said interior.

5. Apparatus as in either claim 1 or 4 wherein said float body is plastic.

6. Apparatus as in either claim 1 or 4 wherein said diver's floater further comprises removable connection means attached to said float body for connecting equipment to said diver's floater external to said float body.

7. Apparatus as in either claim 1 or 4 wherein said float is spherical and has a circumferential groove around which said flexible means is wound during storage.

8. Apparatus as in claim 7 wherein said retaining means comprises a resilient clip attached to a wall of said circumferential groove, for maintaining preselected points of said flexible means proximate said groove wall.

9. Apparatus as in either claim 1 or 4 wherein said flexible means is marked at predetermined lengths so as to provide an indication of distance from the end of said flexible means.

10. Apparatus as in claim 4 wherein:

said diver's floater further comprises at least one interior wall; and said means for storing equipment comprises clips attached to said at least one interior wall and an equipment rack, said clips releasably engaging said rack so as to maintain the position of said rack constant relative to the interior of said float body when said storing means is engaged in said clips.

11. A diver's floater comprising:

a spherical float body having a circumferential groove and an average specific gravity less than that of water;

flexible means, having one end attached to said float body, for connecting said float body to said diver, said flexible means being wound around said float body and disposed in said groove during storage;

a resilient clip attached to a wall of said groove and operatively associated with said flexible means, for maintaining preselected points of said flexible means proximate said groove wall until a predetermined force is applied to said flexible means, said preselected points being separated by a distance greater than the circumference of said groove, to prevent more than preselected lengths of said flexible means from unwinding from said float body until a predetermined force is applied to said flexible means, said preselected lengths being greater than the circumference of said groove.

12. A diver's floater comprising:

a hollow float body having an interior wall, an average specific gravity less than that of water, and means defining holes in said float body, said hole defining means having threads, said float body being spherical and having a circumferential groove therein;

flexible means, having one end attached to said float body, for connecting said float body to said diver, said flexible means being wound around said float body and disposed within said groove during storage;

retaining means, attached to a wall of said groove and operatively associated with said flexible means, for maintaining preselected points of said flexible means proximate said groove wall until a predetermined force is applied to said flexible means, said preselected points being separated by a distance greater than the circumference of said groove, and said retaining means for preventing more than preselected lengths of said flexible means from unwinding from said groove until said predetermined force is applied to said flexible means, said preselected lengths being greater than the circumference of said groove;

handle means, having threads for detachable engagement with said hole defining means threads for for providing access to the interior of said body when said handle means are removed and for providing a watertight seal when said handle means are engaged;

clips attached to said interior wall of said float body; and a rack for holding equipment, said rack detachably engaging said clips so as to maintain the position of said rack constant relative to the interior of said float body when said rack is engaged in said clips.

13. Apparatus as in either claim 2 or 12 wherein the outer contour of said handle means conforms to the general outer contour of said float body when said handle means engage said diver's floater.

* * * * *